United States Patent [19]

Halford

[11] 4,140,276

[45] Feb. 20, 1979

[54] TOY VEHICLE TRACK INTERSECTION

[75] Inventor: Wayne R. Halford, Manhattan Beach, Calif.

[73] Assignee: Mattel, Inc., Hawthorne, Calif.

[21] Appl. No.: 863,592

[22] Filed: Dec. 22, 1977

[51] Int. Cl.[2] ..... A63H 18/02

[52] U.S. Cl. ..... 238/10 R; 46/1 K; 104/54; 104/60; 238/10 F

[58] Field of Search ..... 238/10 R, 10 A, 10 B, 238/10 C, 10 E, 10 F; 104/53, 54, 60, 147 A, DIG. 1; 273/86 R, 86 B; 46/1 K, 202, 206, 257, 258, 259, 260

[56] References Cited

U.S. PATENT DOCUMENTS

| | | | |
|---|---|---|---|
| 2,636,114 | 4/1953 | Fields | 104/60 X |
| 3,205,833 | 9/1965 | Fitzpatrick | 104/60 |
| 3,206,122 | 9/1965 | Frisbie et al. | 238/10 F |
| 3,218,757 | 11/1965 | Benkoe | 104/53 X |
| 3,290,498 | 12/1966 | Lahr | 238/10 F X |
| 3,316,401 | 4/1967 | Cramer | 238/10 F X |
| 3,377,958 | 4/1968 | Bax et al. | 238/10 F X |
| 3,402,503 | 9/1968 | Glass et al. | 238/10 F X |
| 3,584,410 | 6/1971 | Lalonde | 273/86 B X |
| 3,630,524 | 12/1971 | Cooper et al. | 273/86 R |
| 3,680,488 | 8/1972 | Donlon | 104/130 |
| 3,717,346 | 2/1973 | Merino et al. | 273/86 R |
| 3,735,923 | 5/1973 | Brigham et al. | 238/10 E |
| 3,858,875 | 1/1975 | Nemeth et al. | 104/54 X |
| 3,860,237 | 1/1975 | Cooper et al. | 273/86 R |

*Primary Examiner*—Francis S. Husar
*Assistant Examiner*—Randolph A. Reese
*Attorney, Agent, or Firm*—John G. Mesaros; Max E. Shirk; Ronald M. Goldman

[57] ABSTRACT

A track intersection for use with a plurality of other track sections to form a trackway for passage of toy vehicles thereon, the intersection having a curved trackway section having generally parallel opposed sidewalls of height generally equal to the height of the toy vehicle. The intersection is provided with an elevated roadway portion at the height of the sidewalls, the elevated roadway portion having first and second trackways, the first trackway being generally tangential to the exit end of the curve to permit a toy vehicle to enter the first trackway and leave the intersection through the exit end of the curve. The second trackway generally intersects the first trackway to permit a toy vehicle to leap the curve on the elevated roadway portion.

6 Claims, 3 Drawing Figures

TOY VEHICLE TRACK INTERSECTION

BACKGROUND OF THE INVENTION:

The background of the invention will be discussed in two parts:

2. Field of the Invention

This invention relates to track sections for toy vehicles, and more particularly to a track intersection for such vehicles.

2. Description of the Prior Art

Miniature motor operated toy vehicles have become very popular. Some of such vehicles are of the slot-car type wherein the toy vehicle is provided with a depending guide pin on the undersurface thereof for engagement with a continuous slot formed in a trackway for guiding the vehicle. Other such vehicles are provided with rechargeable batteries for motor operation and are not provided with guide pins or the like, the vehicles generally being confined to a given trackway by upwardly extending wall portions or curbs on either side of the trackway. Such trackways are generally formed in interlocking sections to enable the user to duplicate a number of different "race courses". Some track sections are intersections on a common plane while other track sections may provide bi-level cross-over. Intersections of the former type are shown in U.S. Pat. Nos. 3,630,524; 3,584,410; 3,377,958; 3,316,401; 3,205,833; and 2,636,114.

Some track sections are provided with support means to provide an elevated cross-over for a Figure 8 as shown in U.S. Pat. No. 3,206,122. In U.S. Pat. No. 3,402,503 a bi-level cross-over is provided to enable a vehicle to jump a gap between proximately spaced track sections.

It is an object of this invention to provide a new and improved toy vehicle track intersection.

It is another object of this invention to provide a toy vehicle track intersection of unitary construction with a lower level curve and an upper level intersection.

SUMMARY OF THE INVENTION

The foregoing and other objects of the invention are accomplished by providing a track intersection of unitary construction having a curve trackway section with generally parallel opposed sidewalls with an upper or elevated roadway portion having first and second trackways, the first trackway being generally tangential to the exit end of the curve for enabling a toy vehicle to enter the first trackway and exit at the exit end of the curve. The second trackway generally intersects the first trackway to enable a vehicle to leap the curve while remaining on the elevated roadway portion.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
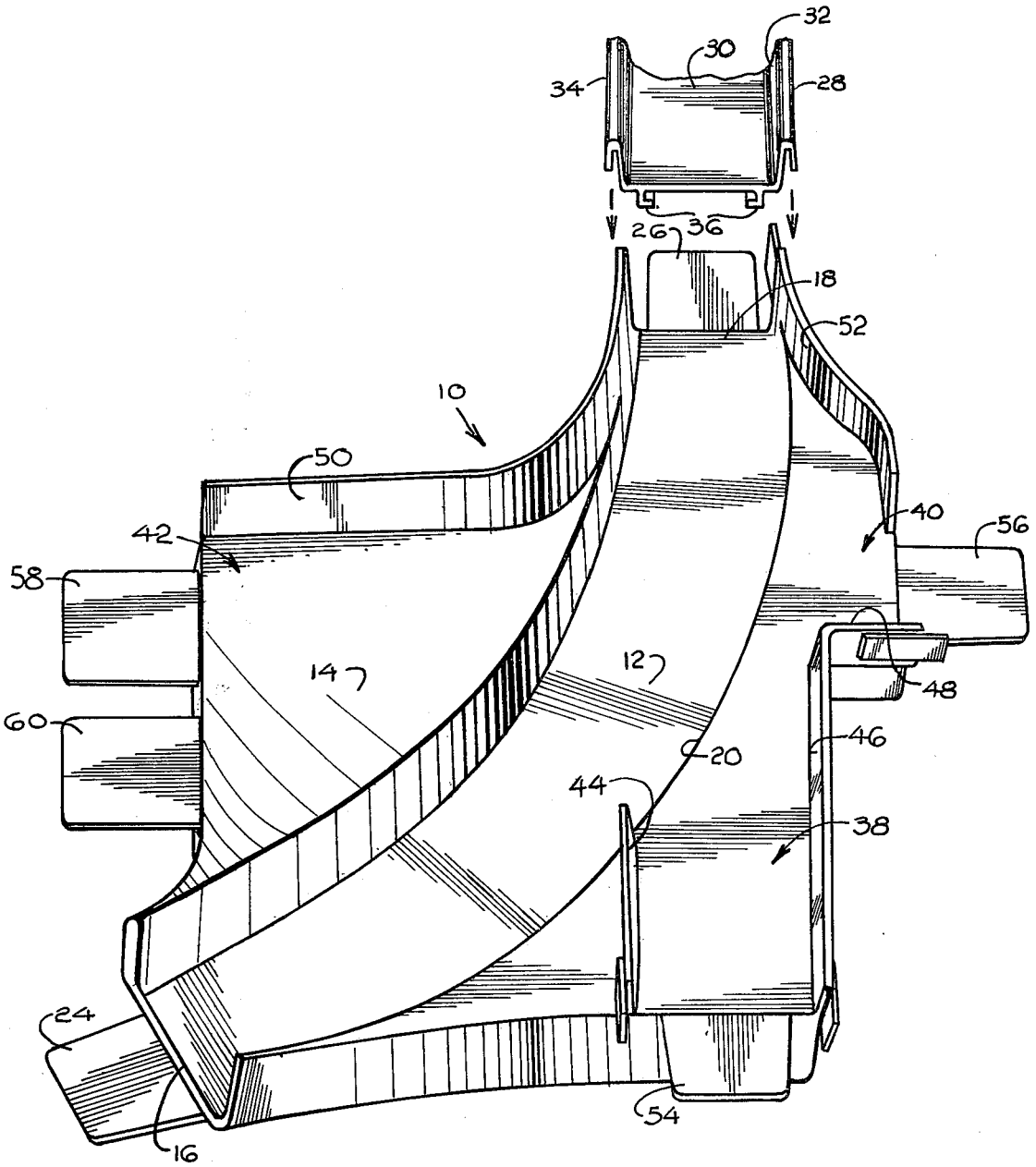
FIG. 1 is a perspective view of the toy vehicle track intersection according to the invention.

Referring to the drawings, and more particularly to FIG. 1, there is shown a toy vehicle track section generally designated 10 which is of a unitary construction, preferably formed of a molded plastic material, the intersection 10 having a lower roadway portion 12 and an elevated roadway portion 14, the lower roadway portion 12 being in the form of a single lane curve having an entrance end 16 and an exit end 18. The curved roadway portion 12 has on either side thereof opposing parallel sidewalls 20 and 22 for maintaining a toy vehicle within the roadway portion 12 during travel thereon. At either end of the roadway portion 12 the intersection 10 is provided with planar outwardly extending integral tongues 24 and 26, integral with the bottom of the intersection 10 for suitably connecting the intersection to other track sections such as track section 28 (only partially shown) which has a roadway 30 with upwardly extending curbs 32 and 34, the undersurface of roadway 30 being provided with suitable conventional means such as channels 36 for interlocking with tongue 26 in tight frictional engagement. The upper or elevated roadway portion 14 is configured to provide a first trackway 38 and a second trackway having an entrance end 40 on one side of the curved roadway portion 12 and an exit end 42 on the other side of the curved roadway portion 12.

The first trackway 38 is generally tangential to the center of the curve of the curve roadway portion 12 with the center of trackway 38 being on a line passing through the center of the curve of the roadway portion 12 adjacent the exit end 18 thereof. The first trackway 38 is provided with parallel opposing upwardly extending wall portions 44 and 46 for guiding the vehicle, the intended direction of travel of the vehicle on trackway 38 being into the curve, that is the vehicle will enter the trackway 38 with the momentum of the vehicle carrying it into the roadway portion 12 to leave at the exit end 18 thereof to pass onto the roadway 30 of the next track section. Similarly, the intended direction of travel of a toy vehicle on the roadway portion 12 is from the entrance end 16 through the roadway portion 12 to leave by means of the exit end 18.

The second trackway defined by trackway portions 40 and 42 is generally perpendicular to the line of the first trackway 38 with the wall portion 46 being bent at 48 to form a portion of the wall for the trackway portion 40. The exit end of the second trackway portion 42 is provided with a generally planar surface slightly inclined downwardly with a portion of the surface adjacent wall 22 being slightly lower in elevation than the elevation of trackway portion 40 to permit the toy vehicle to "leap" the gap. A guide wall 50 extends generally perpendicular to the plane of the trackway portion 42 and continues around towards the exit end 18 of the roadway portion 12 to form a portion of the wall for the lower lane. Similarly, a wall 52 is provided at the exit end 18 opposite the wall 50. The first trackway 38 is provided with an interconnecting tongue 54 and the second trackway portions 40 and 42 are likewise provided with interconnecting tongues 56, 58 and 60 for connection to other track sections.

Figure 2:
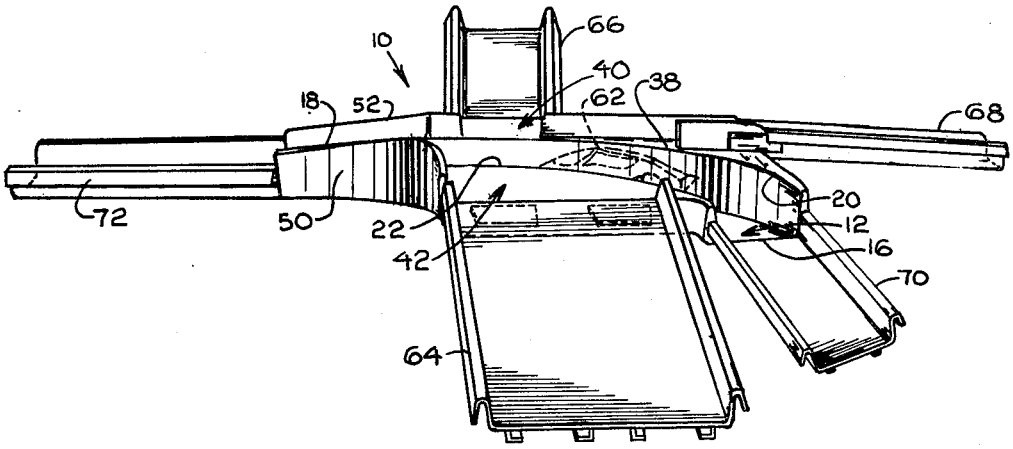
FIG. 2 is a perspective view of the track intersection of FIG. 1 rotated approximately 90 degrees with additional track sections coupled thereto, the angle of viewing approaching horizontal.

Referring now to FIG. 2, additional track sections have beed added in an interconnecting relation with the intersection 10, and the intersection 10 is illustrated at a perspective angle very close to horizontal. At this angle it can be seen that the sidewall 20 of the curve 12 is slightly higher than the sidewall 22 with the car 62 within curve 12 having the top thereof approximately equal in height to the top of sidewall 20 so that a car entering the second trackway section 40 will be able to clear the roof of the car 62 and land on the trackway portion 42 for traversal down the inclined ramp of track section 64, which is a two-lane track section. The entry end of trackway portion 40 is provided with a single lane track section 66. Similarly, a single track section 68 is coupled to the first trackway portion 38; a single lane track section 70 is coupled to the entrance end 16 of curve roadway portion 12 and a single lane track section 72 is coupled to the exit end 18 of the curved roadway portion 16. As also can be seen since the roadbed of the first trackway section 38 is at an elevation equal to the height of sidewall 20 as a car enters over track section 68 over trackway 38, it can clear a car in the position of toy vehicle 62 to land in the funnel provided by upwardly extending sidewalls 50 and 52 to land in the exit end of curve 12 to depart through trackway section 72.

Figure 3:
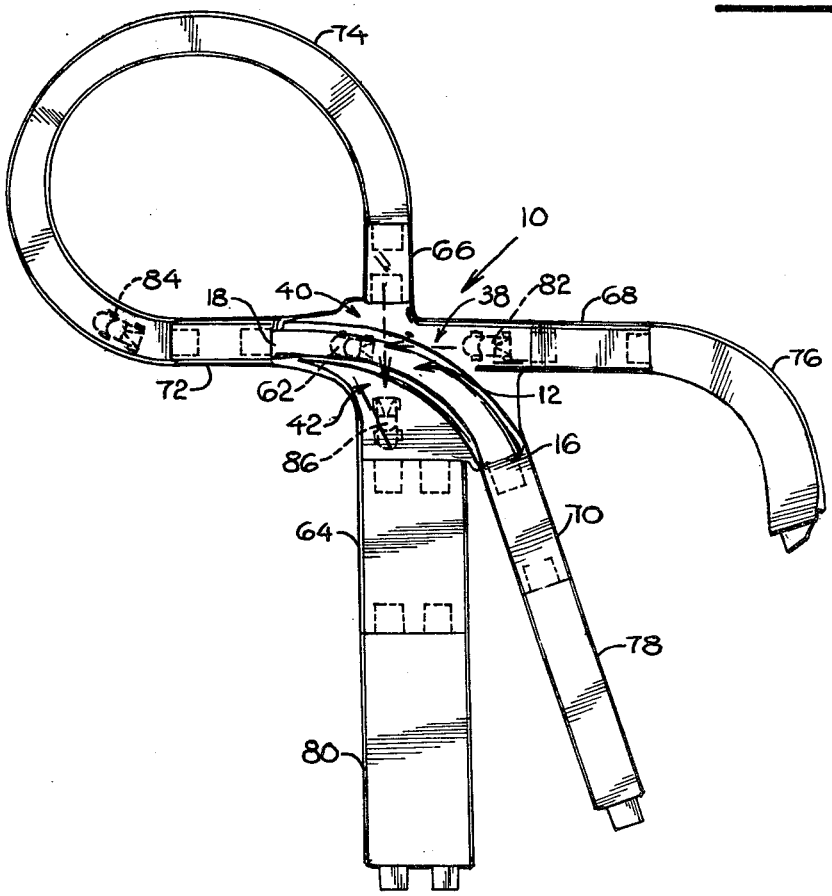
FIG. 3 is a plan view of a portion of a toy vehicle track layout utilizing the track intersection of FIG. 1.

As illustrated in plan view in FIG. 3, additional track sections have been added, these including a 270° curve 74 interconnecting track sections 72 and 66; a 90° curve 76 connected to the end of track section 68; an additional single lane straight track section 78 connected to track section 70 and a two-lane track section 80 coupled to track section 64. Three additional toy vehicles 82, 84 and 86 have been placed in position and the operation of the intersection 10 will be discussed. With a vehicle 62 within the curve 12, a toy vehicle 82 on the first trackway 38 of the elevated roadway portion 14 can leap the vehicle 62, if its speed is faster than that of vehicle 62, to land in the exit end 18 of the curved roadway portion 12. The vehicle 84 is travelling along a clockwise path about the curve 74 and at the point it reaches the second trackway portion 40, with a vehicle 62 within the curve 12, it can leap the gap to the position depicted by toy vehicle 86 to the then travel the two-lane roadway comprising track section 64 and 80.

With additional single and double lane track sections, these sections can be connected in various ways to provide different race course layouts with intersection 10 providing substantial amusement value when a plurality of vehicles are traversing the tracks resulting in a random traversal of vehicles through the intersection 10 simulating near misses and leaps. While there has been shown and described a preferred embodiment it is to be understood that various other adaptations and modifications may be made within the spirit and scope of the invention.

What is claimed is:

1. A track intersection for use with a plurality of other track sections to form a track layout for passage of toy vehicles thereon, said intersection comprising:

a curved roadway portion with entrance and exit ends, said portion having generally parallel opposed sidewalls, at least one of said sidewalls having a height generally equal to the height of the toy vehicle; and an elevated roadway portion generally coextensive with the upper edges of said sidewalls, said elevated roadway portion having a first and a second trackway, said first trackway being generally tangential to said curved roadway portion in general alignment with the exit end thereof for enabling a toy vehicle to enter said first trackway section and exit said exit end on said curved roadway portion, said second trackway generally intersecting said first trackway for enabling a vehicle to leap said curved section on said elevated roadway portion.

2. The combination according to claim 1 wherein said first trackway has parallel opposed upwardly extending wall portions.

3. The combination according to claim 2 wherein said intersection is provided with upwardly extending wall portions on opposite sides of the exit end of said roadway portion, said wall portions being configured to form a funnel for directing a toy vehicle at the exit end of said curved roadway portion after leaving said first trackway.

4. The combination according to claim 3 wherein said second trackway has first and second portions on either side of said curved roadway portion, one of said first and second portions being at a higher elevation than the other.

5. The combination according to claim 4 wherein the other of said first and second portions of said second trackway is inclined.

6. The combination according to claim 5 wherein said track intersection is formed in one piece and further includes means for interconnecting said track intersection to other track sections.

* * * * *